US005351924A

United States Patent [19]

Schröder

[11] Patent Number: 5,351,924

[45] Date of Patent: Oct. 4, 1994

[54] FURNITURE MOUNT

[75] Inventor: Gerhard Schröder, Bad Oeynhausen, Fed. Rep. of Germany

[73] Assignee: Paul Hettich GmbH & Co., Kirchlengern, Fed. Rep. of Germany

[21] Appl. No.: 946,337

[22] PCT Filed: Feb. 29, 1992

[86] PCT No.: PCT/DE92/00185

§ 371 Date: Nov. 6, 1992

§ 102(e) Date: Nov. 6, 1992

[87] PCT Pub. No.: WO92/15227

PCT Pub. Date: Sep. 17, 1992

[30] Foreign Application Priority Data

Mar. 7, 1991 [DE] Fed. Rep. of Germany ... 9102703[U]

[51] Int. Cl.[5] ..... F16B 45/00

[52] U.S. Cl. ..... 248/274; 248/222.1; 248/287

[58] Field of Search ..... 248/544, 287, 220.1, 248/222.4; 403/13, 47, 48; 411/386

[56] References Cited

U.S. PATENT DOCUMENTS 3,946,979 3/1976 Ehlebracht et al. ..... 248/274
4,232,497 11/1980 Meschnig ..... 411/386 X
4,473,316 9/1984 Welch ..... 248/222.4 X

FOREIGN PATENT DOCUMENTS 1429566 3/1969 Fed. Rep. of Germany .
2301914 7/1974 Fed. Rep. of Germany ..... 248/287
2908385 9/1980 Fed. Rep. of Germany ..... 248/274
2195290 3/1974 France .

*Primary Examiner*—Alvin C. Chin-Shue
*Assistant Examiner*—Derek J. Berger
*Attorney, Agent, or Firm*—Darby & Darby

[57] ABSTRACT

A mount for a furnishing has a housing which is designed to be attached to the furnishing. A carrier is mounted in the housing for horizontal and vertical displacement and has a hook-like end portion which projects from the housing and can engage a hook on a wall. The housing is provided with a horizontal, keyhole-shaped slot, and a vertical screw is mounted in the slot and meshes with a thread in the carrier. The vertical screw, which serves to shift the carrier vertically, if fixed against axial displacement but is movable along the slot as the carrier is shifted horizontally. A horizontal screw is likewise held on the carrier so as to be fixed against axial displacement and serves to shift the carrier horizontally. The horizontal screw has a threaded section designed to mesh with a thread in the carrier and an unthreaded section which extends from the threaded section to the end of the screw. The unthreaded section prevents complete separation of the horizontal screw and the carrier in the event that the threads become disengaged thereby facilitating reengagement of the screw and the carrier. The horizontal screw is designed in such a manner that the vertical screw bears against an end of the slot remote from the horizontal screw at the time that the threaded section of the horizontal screw becomes disengaged from the carrier.

17 Claims, 1 Drawing Sheet

FURNITURE MOUNT

Figure 1:
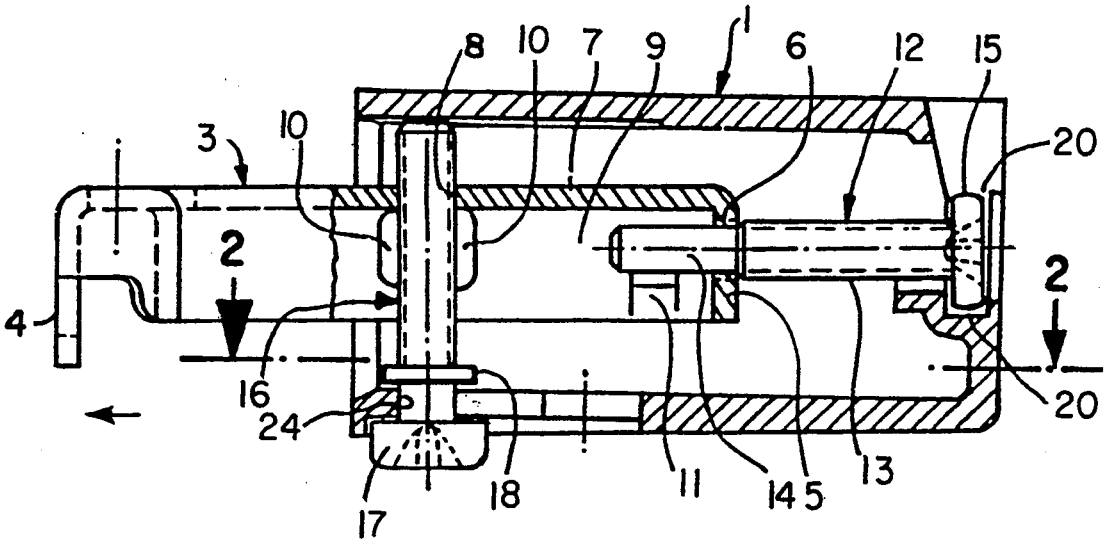

The invention relates to furniture mounts consisting of a housing which can be affixed to furniture and a horizontally and vertically adjustable carrying component movably supported in the housing. Horizontal and vertical adjustment each take place by means of a respective screw which is in threaded engagement with the carrying component.

Many designs for such mounts are known. The purpose of the horizontal and vertical adjustment is to be able to compensate for unevennesses at the building wall and/or positional inaccuracies of the carrying elements on the wall side during mounting of the furniture.

However, precisely during the horizontal adjustment, it has been found that the horizontal adjusting screw is frequently rotated out too far as a result of unawareness so that the threaded connection between carrying component and horizontal adjusting screw is broken. For all practical purposes, the adjustability in the horizontal direction is then lost because, due to the dropping of the cabinet under its weight, and due to the lack of a view into the housing of the mount, the horizontal adjusting screw cannot, or can only with great difficulty, again be screwed into the carrying component.

To prevent this unintentional separation of horizontal adjusting screw and carrying component, it has been proposed to attach to the end of the horizontal adjusting screw a safety disc or, by subsequent deformation of the end of the screw, to provide a thickening which prevents the screw from rotating out of the internal thread of the carrying component. Both proposals result in additional manufacturing costs and significantly increase the difficulty of assembling the individual parts, i.e., the assembly costs increase also.

The object of the present invention is to provide an economical solution which, with a minimum expenditure for manufacturing and assembly, reliably and inexpensively prevents a complete separation of carrying component and horizontal screw—while excluding all of the drawbacks associated therewith—.

This object is achieved in that the end of the horizontal adjusting screw carries an unthreaded portion of smaller diameter and that the thread-carrying portion in no longer in threaded engagement with the internal thread of the carrying component when the carrying component is in a terminal position inside the housing.

The terminal position of the carrying component in the housing is established in a simple manner by projections/ abutments affixed to the housing or the carrying component, or by abutment of the vertical adjusting screw against the narrow end of the keyhole-shaped, slotted hole.

The diameter of the unthreaded portion is favorably equal to or smaller than the root diameter of the thread. It can be of advantage to select the ratio of the lengths of the threaded portion and the unthreaded portion so that the threaded portion is approximately $\frac{2}{3}$ and the unthreaded portion $\frac{1}{3}$.

Figure 2:
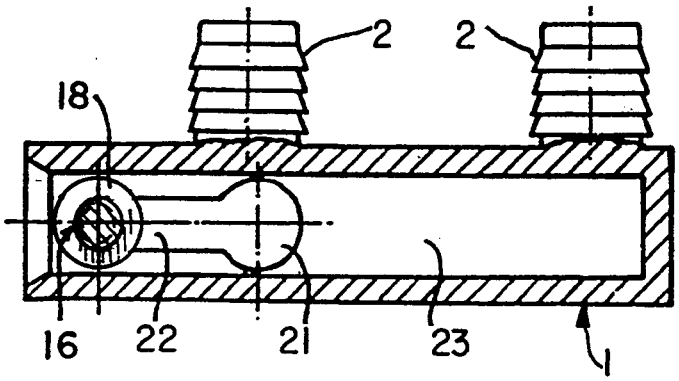

A preferred exemplary embodiment is illustrated in the drawings. There is shown:

FIG. 1 a sectioned housing with partially sectioned carrying component in a terminal position of the carrying component, FIG. 2 the bottom zone of the hosing with the keyhole-shaped, slotted hole in a sectional view along the line II—II of FIG. 1.

The mount consists of the housing 1 which, in a known manner not illustrated in greater detail, can be secured to the furniture by means of pegs 2 formed on the housing 1 or by means of screws.

The movably supported carrying component 3, which has essentially an approximately U-shaped outline, is located in the interior of the housing 1. The ends 4 of the carrying component 3, which project out of the housing 1, are hook-shaped for mounting on non-illustrated mounting elements at the building side.

At its other end 5 opposite the hooks 4, the carrying component is provided with an internal thread 6 which is engaged by the thread 13 of the horizontal adjusting screw 12. It being understood that relative orientation adjectives such as "horizontal", "vertical", etc. are utilized herein to simplify the present description and are not intended to limit the orientation of the furniture mount assembly when in use.

A further internal thread 8, which is engaged by the vertical adjusting screw 16, is provided in the central zone in the yoke of the carrying component 3 of U-shaped outline.

Corrugations 10,11, which guide the horizontal and vertical adjusting screws and absorb transverse or lateral forces which may arise, are additionally provided in the lateral legs 9 of the carrying component 3.

In addition to its first section or threaded portion 13, the horizontal adjusting screw 12 carries a second section or unthreaded portion 14. The head 15 of the horizontal adjusting screw 12 is guided in a pocket 20 of the housing 1 so as to be rotatable and immovable in longitudinal direction.

The vertical adjusting screw is also guided in the housing 1 so as to be rotatable and immovable in longitudinal direction; however, the vertical adjusting screw 16 is additionally still shiftable transverse to its longitudinal direction within the keyhole-shaped, slotted hole 22. The immovableness of the vertical adjusting screw 16 in longitudinal direction is effected by a collar 18 formed in the vicinity of its head 17. The collar 18 is dimensioned such that it can be passed through the expanded opening 21 of the keyhole-shaped, slotted hole 22 in the bottom 23 of the housing 1.

After insertion of the vertical adjusting screw 16 in the expanded opening 21 of the slotted hole 22 so that the head 17 comes into abutment, and after lateral shifting of the vertical adjusting screw 16 out of the area of the expanded opening 21, the vertical adjusting screw 16 is prevented by its collar 18 from falling out of the slotted hole 22.

The details of assembling the individual components 3,12, 16, which are known per se, will not be further described here.

In assembled condition, the heads 15,17 of the adjusting screws 12,16 lie in the area of the outer walls of the housing 1 and are accessible for the adjusting tools (screw drivers, etc.).

The operation of the novel security mechanism against complete separation of carrying component 3 and horizontal adjusting screw 12 is as follows:

When the mount is installed in the furniture and the installer, during final alignment of the wall furniture, rotates the horizontal adjusting screw 12 so that the carrying component 3 moves out of the housing 1 in the direction of the arrow A, the first coupling or threaded portion 13 eventually leaves the second coupling portion or internal thread 16 of the carrying component 3. However, a complete separation of the components 3 and 12 does not occur because an unthreaded portion 14, which remains in the bore of the internal thread 6, adjoins the threaded portion 13. Neither are there disruptive deformations of the internal thread 6 here since the unthreaded portion 14 is supported on the corrugation 11 and the horizontal adjusting screw 12 remains in the position shown in FIG. 1 even load. A change in the rotational sense of the horizontal adjusting screw 12 causes the threaded portion 13 of the height adjusting screw 12 to once more be screwed into the internal thread 6 of the carrying component 3.

The process of again screwing in is facilitated in that, during the phase when internal thread 6 and threaded portion 13 are no longer in engagement,—as shown in FIG. 1 —the vertical adjusting screw 16 lies against the end 24 of the keyhole-shaped, slotted hole 22. Inside the housing 1, the carrying component 3 is located in a fixed terminal position which—as mentioned—greatly simplifies the renewed screwing of the horizontal adjusting screw 12 into the internal thread 6 of the carrying component 3. It is thus advantageous to adjust the length of the threaded portion 13 relative to the length and position of the keyhole-shaped, slotted hole 22 such that the vertical adjusting screw comes into abutment when the threaded portion 13 has left the internal thread 6 of the carrying component 3.

The terminal position of the carrying component 3 in the housing 1 can, of course, also be set by other abutments such as noses, projections, etc. which are formed on the housing 1 or on the carrying component 3 and set a terminal position of the carrying component 3 in the manner described.

I claim:

1. A mount for furnishings, comprising a housing for attachment to a furnishing; a carrier movable relative to said housing in both a horizontal and a vertical direction; and means for moving said carrier relative to said housing including a vertical adjusting screw and a horizontal adjusting screw, said horizontal adjusting screw moving said carrier from a first horizontal position to a second horizontal position, said second horizontal position being a terminal position of said carrier, said horizontal adjusting screw having a first section and a second section constituting an extension of said first section, said first section having a first coupling portion and said carrier having a second coupling portion which is complementary to said first coupling portion, said first coupling portion being coupled to said second coupling portion when said carrier is in said first horizontal position, said second section having a smaller cross section than said first section, said second section becoming disposed within and threadably disengaged from said second coupling portion when said carrier is moved into said second horizontal position.

2. The mount of claim 1, wherein said horizontally adjusting screw is arranged to move said carrier to and from said terminal position, said horizontally adjusting screw being designed so that said first and second coupling portions are disengaged from one another when said carrier is in said terminal position.

3. The mount of claim 2, wherein said carrier is at least partially accommodated in said housing when said carrier is in said terminal position.

4. The mount of claim 1, wherein said horizontal adjusting screw is designed so that said second section is received by said carrier upon disengagement of said first and second coupling portions from one another.

5. The mount of claim 1, wherein said horizontal adjusting screw is arranged to move said carrier substantially horizontally.

6. The mount of claim 5, wherein said vertical adjusting screw is arranged to move said carrier substantially vertically.

7. The mount of claim 1, wherein said horizontal adjusting screw has an axial end portion and said axial end portion constitutes part of said second section.

8. The mount of claim 7, wherein said horizontal adjusting screw includes a shank which is provided with said axial end portion, said shank further being provided with ahead that is disposed at a second axial end portion which is remote from said axial end portion.

9. The mount of claim 1, wherein said first and second coupling portions comprise threads.

10. The mount of claim 9, wherein said second section is unthreaded.

11. The mount of claim 1, wherein said sections are substantially cylindrical and the diameter of said second section is smaller than the diameter of said first section.

12. The mount of claim 1, wherein said horizontal adjusting screw is arranged to move said carrier to and rom said terminal position, said horizontal adjusting screw being designed so that said first and second coupling portions are disengaged from one another when said carrier is in said terminal position, said vertical adjustment screw abutting said housing in said terminal position.

13. The mount of claim 1, wherein said horizontal adjusting screw is arranged to move said carrier to and from said terminal position along a first direction and said vertical adjusting screw is arranged to move said carrier along a second direction transverse to said first direction, said housing being provided with an elongated slot which extends along said first direction and has an abutment end, and said vertical adjusting screw being mountable in said slot for movement along said first direction together with said carrier, said horizontal adjusting screw being designed so that said first and second coupling portions are disengaged from one another when said carrier is in said terminal position, and said abutment end engages said vertical adjusting screw in said terminal position.

14. The mount of claim 13, wherein said slot is substantially keyhole-shaped and has another end which is remote from, and wider than, said abutment end.

15. The mount of claim 1, wherein said first coupling portion comprises a thread having a predetermined root diameter, said second section having a diameter equal to or less than said predetermined root diameter.

16. The mount of claim 1, wherein said first section has a first length and said second section has a second length at least approximately equal to one-half of said first length.

17. The mount of claim 1, wherein said vertical adjusting screw is coupled to said carrier such that said vertical adjusting screw is horizontally movable relative to said housing.

* * * * *